US012391416B2

(12) United States Patent
Boerret et al.

(10) Patent No.: US 12,391,416 B2
(45) Date of Patent: Aug. 19, 2025

(54) DEVICE FOR PROCESSING PHARMACEUTICAL CONTAINERS, AND FILLING DEVICE

(71) Applicant: Bausch + Ströbel SE + Co. KG, Ilshofen (DE)

(72) Inventors: Florian Boerret, Gaildorf (DE); Simon Ackermann, Frankenhardt (DE); Fabian Kleinheinz, Blaufelden (DE)

(73) Assignee: Bausch + Stroebel SE + Co. KG, Ilshofen (DE)

( * ) Notice: Subject to any disclaimer, the term of this patent is extended or adjusted under 35 U.S.C. 154(b) by 154 days.

(21) Appl. No.: 18/339,473

(22) Filed: Jun. 22, 2023

(65) Prior Publication Data

US 2023/0406554 A1 Dec. 21, 2023

Related U.S. Application Data

(63) Continuation of application No. PCT/EP2021/087237, filed on Dec. 22, 2021.

(30) Foreign Application Priority Data

Dec. 23, 2020 (DE) ..... 10 2020 134 859.2

(51) Int. Cl.
*B65B 3/00* (2006.01)
*B65B 3/28* (2006.01)
(Continued)

(52) U.S. Cl.
CPC ..... *B65B 3/003* (2013.01); *B65B 3/28* (2013.01); *B65B 7/16* (2013.01); *B65B 7/2807* (2013.01);
(Continued)

(58) Field of Classification Search
CPC .. B65B 3/003; B65B 3/28; B65B 7/16; B65B 7/2807; B65B 7/2821; B65B 43/52;
(Continued)

(56) References Cited

U.S. PATENT DOCUMENTS 3,491,804 A * 1/1970 Niclas ..... B65B 43/52 141/125
3,939,626 A * 2/1976 Cioni et al. ..... B65B 3/003 53/381.1
(Continued)

FOREIGN PATENT DOCUMENTS

CA 3128096 A1 9/2020
CN 107499550 A 12/2017
(Continued)

OTHER PUBLICATIONS

Search Report received in International Application No. PCT/EP2021/087243, dated Jun. 20, 2022, with translation, 8 pages.
(Continued)

*Primary Examiner* — Stephen F. Gerrity
(74) *Attorney, Agent, or Firm* — Christopher A. Rothe; CM Law

(57) ABSTRACT

An apparatus for processing pharmaceutical containers, in particular vials, syringes or carpules, and a filling device for filling pharmaceutical containers. The apparatus includes a frame that can be positioned on a set-down surface and has a surface, a first side and a second side, a processing station, and a transport device arranged between the first side and the second side, with circulating holding elements for the containers which move along a transport direction on a transport segment and counter to the transport direction on a return segment. The processing station is arranged at the transport segment, and the transport segment and the return segment are arranged above the surface. The transport plane is inclined by an angle of inclination relative to a plane of the
(Continued)

surface and/or a horizontal plane, and the transport segment is arranged above the return segment in the direction of gravity.

30 Claims, 10 Drawing Sheets

(51) Int. Cl.
*B65B 7/16* (2006.01)
*B65B 7/28* (2006.01)
*B65B 43/52* (2006.01)
*B65B 65/00* (2006.01)

(52) U.S. Cl.
CPC ..... *B65B 7/2821* (2013.01); *B65B 43/52* (2013.01); *B65B 65/003* (2013.01)

(58) Field of Classification Search
CPC .. B65B 65/003; B65G 17/323; B65G 47/841; B65G 47/842; B65G 47/847
USPC ..... 53/282; 198/470.1, 474.1
See application file for complete search history.

(56) References Cited

U.S. PATENT DOCUMENTS

| | | | | |
|---|---|---|---|---|
| 3,940,909 | A * | 3/1976 | Cioni et al. | B65B 3/003 53/381.2 |
| 6,082,077 | A | 7/2000 | Christ | |
| 7,753,085 | B2 | 7/2010 | Tribble et al. | |
| 9,043,019 | B2 | 5/2015 | Eliuk et al. | |
| 11,260,574 | B2 | 3/2022 | Poeschl et al. | |
| 2015/0274436 | A1 | 10/2015 | Di Donna et al. | |
| 2016/0038669 | A1 | 2/2016 | Bars | |
| 2017/0225814 | A1* | 8/2017 | Eberhardt et al. | B65B 3/003 |
| 2018/0162572 | A1 | 6/2018 | Trilli et al. | |
| 2018/0186481 | A1* | 7/2018 | Franke et al. | B65B 3/003 |
| 2021/0221547 | A1* | 7/2021 | Zaniboni | B65B 43/52 |

FOREIGN PATENT DOCUMENTS

| | | | | |
|---|---|---|---|---|
| DE | 10211121 | A1 | 10/2003 | |
| DE | 102008001287 | A1 | 10/2009 | |
| DE | 102010043160 | A1 | 5/2012 | |
| DE | 10246061 | B4 | 9/2012 | |
| DE | 102015103833 | | 2/2016 | |
| DE | 102019202726 | A1 | 9/2020 | |
| EP | 0298407 | A2 * | 1/1989 | B65B 3/28 |
| WO | 2005123551 | A1 | 12/2005 | |
| WO | 2019048677 | A1 | 3/2019 | |

OTHER PUBLICATIONS

Search Report received in International Application No. PCT/EP2021/087237 dated Aug. 3, 2022, with translation, 8 pages.

* cited by examiner

DEVICE FOR PROCESSING PHARMACEUTICAL CONTAINERS, AND FILLING DEVICE

CROSS-REFERENCE TO RELATED APPLICATIONS

This application is a continuation patent application of international application number PCT/EP2021/087237, filed on Dec. 22, 2021, and claims the benefit of German application number 10 2020 134 859.2, filed Dec. 23, 2020. The contents of international application number PCT/EP2021/087237 and German application number 10 2020 134 859.2 are incorporated herein by reference in their entireties and for all purposes.

FIELD

The present disclosure relates to an apparatus for processing pharmaceutical containers, in particular vials, syringes or carpules. The apparatus serves in particular to fill the containers with a pharmaceutical substance. For this purpose, a filling station of the apparatus is preferably provided. The pharmaceutical substance is in particular a medically active substance (agent).

The present disclosure also relates to a filling device for filling pharmaceutical containers.

BACKGROUND

As explained below, containers of different types can preferably selectively be processed with the apparatus. The containers of different types in particular include vials, syringes and/or carpules. Vials may also be referred to as "bottles" or "phials." Containers can also be referred to as "vessels."

An object underlying the present disclosure is to provide an apparatus of the type mentioned at the onset with a compact design.

SUMMARY

In a first aspect of the present disclosure, an apparatus for processing pharmaceutical containers, in particular vials, syringes or carpules, is provided. The apparatus comprises:

- a frame which can be positioned on a set-down surface and has a surface, a first side and a second side opposite thereto,
- at least one processing station for the containers, and
- a transport device, which is arranged between the first side and the second side and is in particular linear, with circulating holding elements for the containers which move along a transport direction from a coupling side to a decoupling side on a transport segment and counter to the transport direction on a return segment.

The at least one processing station is arranged at the transport segment, and the transport segment and the return segment define a transport plane of the transport device and are arranged above the surface. The transport plane is inclined by an angle of inclination relative to a plane of the surface and/or a horizontal plane, and the transport segment is arranged above the return segment in the direction of gravity.

In a second aspect of the present disclosure a filling device for filling pharmaceutical containers is provided, which can in particular be a component of the apparatus in accordance with the first aspect. The filling device comprises:

- a frame which can be positioned on a set-down surface and has a surface, a first side and a second side opposite thereto,
- at least one processing station for the containers which comprises a filling station for filling the containers with a pharmaceutical substance, and
- a transport device, which is arranged between the first side and the second side and is in particular linear, with circulating holding elements for the containers which move along a transport direction from a coupling side to a decoupling side on a transport segment and counter to the transport direction on a return segment.

The filling station is arranged on the transport segment, and the transport segment and the return segment define a transport plane of the transport device and are arranged above the surface. The transport plane is inclined by an angle of inclination relative to a plane of the surface and/or a horizontal plane, and the transport segment is arranged above the return segment in the direction of gravity.

BRIEF DESCRIPTION OF THE DRAWINGS

The foregoing summary and the following description may be better understood in conjunction with the drawing figures, of which.

DETAILED DESCRIPTION

Figure 1:
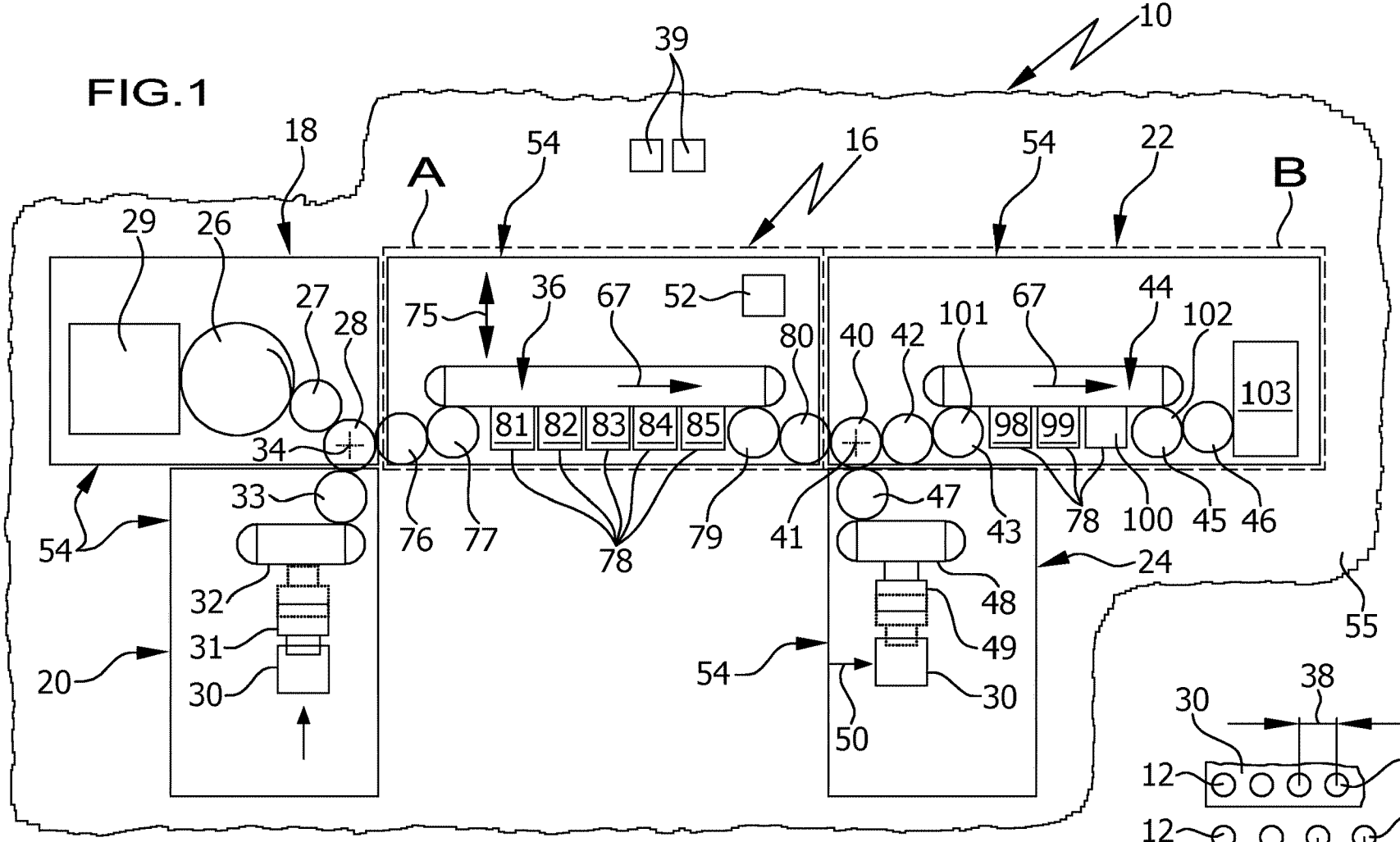
FIG. 1: shows a schematic representation of an apparatus in accordance with the present disclosure for processing pharmaceutical containers, comprising a filling device in accordance with the present disclosure for the pharmaceutical containers.
Figure 2:
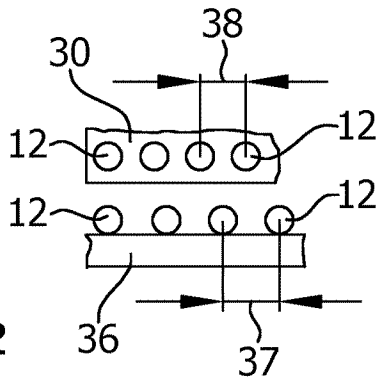
FIG. 2: schematically shows a plurality of pharmaceutical containers (top) accommodated in a common carrier and a plurality of pharmaceutical containers (bottom) held on a transport device of the apparatus.

Although the present disclosure is illustrated and described herein with reference to specific embodiments, the present disclosure is not intended to be limited to the details shown. Rather, various modifications may be made in the details within the scope and range of equivalents and without departing from the present disclosure.

The present disclosure relates to an apparatus for processing pharmaceutical containers, in particular vials, syringes or carpules, the apparatus comprising:

- a frame which can be positioned on a set-down surface and has a surface, a first side and a second side opposite thereto,
- at least one processing station for the containers,
- a transport device, which is arranged between the first side and the second side and is in particular linear, with circulating holding elements for the containers which move along a transport direction from a coupling side to a decoupling side on a transport segment and counter to the transport direction on a return segment, wherein the at least one processing station is arranged at the transport segment, and the transport segment and the return segment define a transport plane of the transport device and are arranged above the surface, and wherein the transport plane is inclined by an angle of inclination relative to a plane of the surface and/or a horizontal plane, and the transport segment is arranged above the return segment in the direction of gravity.

In the apparatus in accordance with the present disclosure, the containers can be coupled into holding elements on the transport segment at the coupling side (hereinafter also referred to as "coupled into the transport segment or transferred thereto") and are moved thereon in particular linearly along the transport direction to the at least one processing station and, after processing, to the decoupling side. On the decoupling side, the containers can be decoupled from the holding elements on the transport segment (hereinafter also referred to as "decoupled from the transport segment or received therefrom"). The transport segment and the return segment define a transport plane. The transport plane can also be considered as a plane of the movement of the transport device. The transport plane is inclined by an angle of inclination relative to a plane of the surface of the frame and/or relative to a horizontal plane. The surface of the frame is defined, for example, by a set-down element of the frame, which is plate-shaped at least in sections and/or is substantially plate-shaped. Due to the inclination of the transport plane, the transport segment is arranged above the return segment in relation to the direction of gravity. It has been shown in practice that the required installation space for the transport device between the first side and the second side can be kept relatively small in this way. In this way, the apparatus can be achieved with a relatively compact design, in particular in a direction from the first side to the second side, for example transverse and in particular perpendicular to the transport direction. It is advantageous in practice if this makes the components of the apparatus, especially of the transport device, very easily accessible for maintenance purposes.

It is moreover advantageous that the return segment and the transport segment are arranged above the surface. This positioning of the transport segment and the return segment above the surface, and thus within an outer contour of the frame, prevents undesired impact of the user. Moreover, it is possible to cover the frame preferably along the entire outer contour with an isolator device for providing an atmosphere for protection and/or for decontamination purposes, wherein the atmosphere is, for example, a protective gas such as $H_2O_2$.

Position and orientation information, such as "above," "below," "horizontal" or the like refer in the present case to use of the apparatus in accordance with specifications. In this case, the frame is positioned on a set-down surface, for example a hall or a laboratory, wherein the set-down surface can be considered as oriented horizontally. The surface preferably defines in particular a horizontal plane.

The apparatus preferably comprises a control device for controlling the operation of the apparatus and also the filling device. It is understood that the apparatus for the respectively active components can have drive devices. These are not explained below. Such drive devices are known to the person skilled in the art.

Preferably, exactly one, preferably linear, transport device of the filling device is provided for the transport of the containers from the coupling side to the decoupling side.

In practice, it has proven to be advantageous if the angle of inclination is greater than 45°, preferably greater than 60° and even more preferably greater than 70°.

In an advantageous embodiment of the present disclosure, the angle of inclination is approximately 80°.

It has proven to be advantageous if the angle of inclination is less than 90°, preferably less than 85°.

At an angle of inclination of, for example, more than 60° and preferably approximately 80°, a relatively small extension of the apparatus in the direction from the first side to the second side can be achieved. Furthermore, it can be advantageous for the transport segment not to be arranged directly above the return segment. This is advantageous in order to prevent damage to and/or contamination of the holding elements on the return segment, for example when a container accidentally falls out of the transport segment and/or the pharmaceutical substance is lost.

It may accordingly be advantageous if the transport device has a free space below the holding elements arranged in the transport segment, wherein the holding elements arranged on the return segment are arranged outside the free space.

The containers held in the holding elements are transported on the transport segment above the free space, preferably in a vertical orientation.

Advantageously, the return segment is arranged offset in the direction of the second side with respect to the free space.

It can be provided that the angle of inclination is unchangeable. Alternatively, it can be provided that the angle of inclination is variable.

It is advantageous if the transport segment and/or the return segment is less distant from the first side than from the second side.

In particular, the free space can be arranged between the return segment and the first side. Further components of the apparatus can engage, for example, in the free space, for example a weighing station.

Preferably, the transport segment is less distant from the first side than the return segment.

The first side and/or the second side can, for example, be a longitudinal side of the frame.

It is advantageous if the transport device is a cycle-based transport device and preferably comprises a plurality of holding element carriers with a respective plurality of holding elements, wherein the containers are processed at the at least one processing station within a predetermined or predeterminable cycle time. A respective holding element carrier comprises a plurality of holding elements. In an advantageous implementation, six holding elements can be provided, for example, wherein the present disclosure is not limited to this number of holding elements. The transport device can be stopped at the at least one processing station in order to process the containers. The cycle time can be the time period between the processing of containers on successive holding element carriers at the same processing station.

Cyclical processing can also be possible if no holding element carriers are provided for the holding elements.

The number of holding elements defines a number of "locations" of the cyclically operating apparatus.

Advantageously, the cycle times at a plurality of processing stations are identical. This enables efficient processing of the containers.

In deviation from the above statements, it may be provided in a preferred embodiment that the transport device is non-cycled but is designed to run continuously.

The holding elements are advantageously designed such that they can cover a plurality of different formats. In this context, "format" is understood in particular to mean containers of different types which differ from one another with regard to their container type (vials, syringes or carpules) and/or with regard to their container properties (such as in particular size).

The apparatus preferably comprises a plurality of format sets with respective format parts, wherein the format parts have holding element carriers and/or holding elements, wherein the format parts of different format sets differ from one another in a container-specific, container-component-specific and/or processing-specific characteristic. In this way, the apparatus has proven to be very versatile. In particular, it is possible to equip the transport device as required with the format parts that are best suited for the respective use.

A distance between container receptacles of the holding elements of different format sets is advantageously identical. This in particular makes it possible to equip the apparatus with a uniform, constant, so-called "pitch" which is independent of the format. This reduces the effort with respect to modifications when changing containers to be processed.

Multiple processing stations may preferably have the same pitch.

In an advantageous embodiment of the present disclosure, the holding elements are holding tongs which can be actively opened and actively closed. During coupling, the holding elements can be guided, for example, via a control contour, as a result of which they are spread for receiving the container. During decoupling, the reverse can apply. At the at least one processing station, the plurality of holding elements can preferably be opened together by means of a control contour.

The containers are preferably guided horizontally over the frame in the transport segment.

Advantageously, the containers in the transport segment are oriented along the direction of gravity.

The transport segment and/or the return segment preferably extends parallel to the first side and/or parallel to the second side.

It is advantageous if the at least one processing station comprises a filling station for filling the containers with a pharmaceutical substance. Accordingly, the apparatus can in particular be or form a filling device for filling the containers.

The filling station advantageously comprises filling elements and a handling device, which is in particular robotic, for the filling elements, wherein the handling device is preferably arranged between the transport segment and the first side. The filling elements are in particular needles which can be lowered into the containers by means of the handling device in order to fill them. Positioned between the transport segment and the first side, the handling device can be reached particularly easily, for example for maintenance purposes.

The handling device is preferably an articulated arm robot or comprises such a robot. The articulated arm robot can be a so-called "Scara" robot, for example.

It can be provided that the containers can be filled while moving in the transport segment, whereby the cycle time can be minimized.

The filling station preferably comprises at least one pump unit and/or metering unit for feeding the substance to the filling elements, which unit is arranged between the return segment and the second side. It has been shown in practice that the pump unit and/or metering unit can in this way be advantageously reached from the second side for maintenance purposes. Fluid conduits for the pharmaceutical substance are preferably guided over the transport device to the filling elements.

The handling device and the pump unit and/or metering unit are advantageously arranged on the frame.

The at least one processing station preferably comprises a first weighing station for weighing the unfilled containers, which is arranged upstream of the filling station in the transport direction. By means of the first weighing station, the tare weight of the containers can be determined with regard to process monitoring to be performed.

The first weighing station is preferably arranged between the transport segment and the first side and, for example, on the frame. In this way, the first weighing station is easily accessible for the user in the event of maintenance.

Weighing elements of the weighing station can preferably be abutted against the containers from below, and the containers can be placed on the weighing elements. For example, the transport device is stopped, and the holding elements are opened when the containers rest on the weighing elements. The weighing station can, for example, engage in the free space below the containers on the transport segment.

The at least one processing station preferably comprises a second weighing station for weighing the filled containers, which is arranged downstream of the filling station in the transport direction. Via the second weighing station, the gross weight of the filled containers can be determined with regard to process monitoring.

The second weighing station is preferably positioned directly downstream of the filling station in the transport direction. With regard to the "locations" of the holding elements in the transport segment, the holding element leading in the transport direction at the filling station is preferably followed by the last holding element of the second weighing station in the transport direction.

The second weighing station is preferably arranged between the transport segment and the first side, for example on the frame.

Weighing elements of the second weighing station can advantageously be placed against the containers from below, and the containers can be placed on the weighing elements. As in the case of the first weighing station, the holding elements are, for example, opened when the containers rest on the weighing elements. The weighing station can, for example, engage in the free space below the containers on the transport segment.

The apparatus can preferably determine whether the containers are filled with a predetermined or predeterminable quantity of the substance, wherein the containers can be refilled via the filling station in the event of a negative determination and insufficient filling quantity. The filling quantity can be determined in particular from the difference between the gross weight and the tare weight. In the case of underfilling, the filling station can be controlled for refilling.

The containers can preferably be refilled at the second weighing station, wherein the filling elements can be fed to the apparatus via a handling device. For example, the handling device of the filling station can position the filling elements above the weighing elements of the second weighing station and refill an underfilled container.

In the case of an overfilled container, it is provided, for example, that it is discharged from the apparatus.

The at least one processing station preferably comprises a closing station for closing the containers with closing elements, wherein the closing station is positioned downstream of a filling station in the transport direction. Preferably, the containers are closed within the transport segment already in order to avoid contamination and/or unintentional spillage of the substance in the filled state.

The closing station is preferably positioned downstream of the aforementioned second weighing station in the transport direction.

The closing station advantageously comprises a lowering unit, by means of which the closing elements can be lowered from above in the direction of the filled containers. The closing elements, for example in the form of mushroom plugs, can be pressed onto the containers from above, wherein the containers are preferably supported from below in this case. Closing elements in the form of plungers can be inserted into the containers, for example.

The lowering unit is preferably arranged between the transport segment on the first side, for example on the frame. In this way, the lowering unit is easy to reach for maintenance purposes.

The closing station preferably comprises a storage unit for storing closing elements and a feed unit for feeding separated closing elements, wherein the storage unit and the feed unit are preferably arranged between the return segment and the second side. The storage unit, for example a pot or the like, is preferably independent of the format. The feed unit comprises, for example, depending on the format to be processed, feed paths which, in the case of modifications, can be easily handled and replaced with little effort. By being positioned between the return element and the second side, the storage unit and the feed unit are easily accessible for maintenance purposes.

The feed unit comprises, for example, at least one feed path which is oriented at an angle to the transport direction. The angle is preferably approximately 30° to 70°, preferably approximately 40° to 60°. It has been shown in practice that a compact design of the apparatus can be achieved by such an orientation of the feed unit.

The closing station preferably comprises a receiving unit for receiving separated closing elements and feeding to the lowering unit, wherein the closing elements can preferably be moved over the transport device. In this case, the closing elements are preferably turned by means of the receiving unit. Inert gas can be applied to one side of the closing elements in the feed unit, which side, as a result of the turning, faces the substance when the containers are being closed. Any foreign particles and/or contaminants on the closing elements can in this way be removed.

The frame is preferably substantially L-shaped in plan view and comprises a first leg and a second leg which is oriented at an angle relative thereto, and they cross one another in a crossing region. The angle is, for example, 90° or substantially 90°.

The transport device is preferably oriented along the first leg, and a feed unit of the closing station preferably extends at least in sections in or through the crossing region. A compact design of the apparatus can be achieved by such a configuration and arrangement of the components.

A monitoring unit for monitoring the presence of a particular closure element on the receiving unit can be provided. If a closure element is missing, it can preferably be conveyed from the feed path into the receiving unit.

The at least one processing station preferably comprises a monitoring station for checking a presence of a closing element on the respective container.

The monitoring station is advantageously arranged between the transport segment and the first side, for example on the frame. In this way, the monitoring station, which is, for example, configured optically, can be easily reached for maintenance purposes.

In the case of a missing closing element, the corresponding container can be discharged, for example.

An advantageous embodiment of the apparatus in accordance with the present disclosure is characterized by 100% monitoring during the processing of the containers. In particular, it can be provided that the filling quantity with the pharmaceutical substance is checked for each container by means of the tare weight and the gross weight, if necessary refilled, and the presence of a closing element on the container is checked.

The apparatus preferably comprises a coupling element for transferring the containers separately to the transport device and/or a decoupling element for receiving the containers separately from the transport device. For example, the coupling element and/or the decoupling element is a respective format part of a format set.

The coupling element and/or the decoupling element is, for example, a transport wheel. The transport wheel can, for example, cyclically feed the containers and cyclically transfer them to or receive them from the holding elements.

Alternatively or additionally, it may be provided that the coupling element and/or decoupling element is a segmented wheel. By means of the segmented wheel, containers, which are, for example, fed continuously, can be transferred cyclically to the holding elements. On the decoupling side, cyclically moving containers can be decoupled continuously.

The coupling element and/or the decoupling element is preferably held on the frame. In the present case, "held on the frame" can be understood to mean, in particular, "arranged on the frame," and vice versa.

The apparatus preferably comprises an introduction element which is arranged upstream of the coupling element in a feed direction, transfers the containers to the coupling element and is held on the frame, wherein preferably no further transport element is held on the frame on the coupling side. The coupling element and at most the introduction element are preferably held on the frame holding the transport device.

Alternatively or additionally, it is advantageous if the apparatus comprises a discharge element which is arranged downstream of the decoupling element in the decoupling direction, receives the containers from the decoupling element and is held on the frame, wherein preferably no further transport element is held on the frame on the decoupling side. Accordingly, the decoupling element and at most the discharge element are preferably held on the frame.

The two advantageous embodiments explained above make it possible to achieve a particularly compact design of a filling device of the apparatus, wherein the filling device comprises the frame with the transport device, the filling station, the weighing stations, the closing station and preferably the monitoring station. By means of the introduction element, containers of a first type can preferably be fed from a first feed unit, or containers of a second type can be fed from a second feed unit.

The containers of the first type are, for example, vials or carpules which are provided as bulk goods ("bulk").

The containers of the second type are, for example, first accommodated in a common carrier ("nest"); these may, for example, be vials, syringes or carpules. Nested containers can also be referred to as RTU containers (RTU=ready-to-use).

Advantageously, the distance of the containers from one another ("pitch") can already be set in the first feed unit to the distance between the receptacles of the holding elements ("machine pitch"). In a corresponding manner, the distance between the containers in the carrier ("nest pitch") is preferably already set to the distance between the receptacles of the holding elements. In this way, the aforementioned filling device can be operated in a versatile manner with the same machine pitch at all times.

The same advantageously applies to the decoupling side. Via the discharge element, the containers can, for example, be delivered to a first removal unit. The removal unit is, for example, provided for storing containers, in particular vials and carpules. For example, the removal unit includes a further closing station, which can be used to finally close already closed containers with crimp caps. Advantageously, both the containers originally provided as bulk goods and the containers removed from the carrier can be transferred to the first removal unit.

A second removal unit can be provided in order to transfer the containers into a common carrier. It is in particular provided that the distance between the containers set to the machine pitch is reset to the nest pitch of the common carrier. It is advantageous in particular if after removal of the containers, the common carrier is transported by the feed unit to the removal unit and the containers are again arranged in this carrier. Advantageously, both the containers originally provided as bulk goods and the containers removed from the carrier can be transferred to the second removal unit.

The apparatus preferably comprises, at at least one and in particular exactly one interface position, an interface element via which containers can selectively be fed from the first feed unit or from the second feed unit. The interface element can, for example, be the coupling element, the introduction element or a transport element for the containers that is arranged upstream therefrom. The interface element is, for example, a transport wheel. Like the introduction element and/or the coupling element, the interface element may be a format part.

It is understood that a modification of the apparatus may possibly be necessary to selectively feed containers from the first feed unit or from the second feed unit. As a result of the use of the interface element, the modification effort, and thus a downtime of the apparatus, can be kept low. Preferably, no modification is required.

It can be provided that different interface elements are to be positioned at the same interface position, depending on the feeding of the containers from the first feed unit or the second feed unit.

The apparatus preferably comprises at at least one and in particular exactly one interface position, an interface element via which the processed containers can selectively be fed to the first removal unit or the second removal unit. The interface element can, for example, be the decoupling element, the discharge element or a further transport element for the containers. The interface element is, for example, a transport wheel. The interface element can be a format part.

It is understood that a modification of the apparatus may possibly be necessary to selectively transfer containers to the first removal unit or to the second removal unit. As a result of the use of the interface element, the modification effort, and thus a downtime of the apparatus, can be kept low. Preferably, no modification is required.

It can be provided that different interface elements are to be positioned at the same interface position, depending on the transfer of the containers to the first removal unit or to the second removal unit.

Further details of the interface elements, feed and removal units that are preferably present are described in the non-prepublished patent application with the title "Apparatus for filling pharmaceutical containers" by the same applicant with the same filing date. The entire disclosure of this patent application is incorporated in its entirety in the present patent application.

The at least one processing station advantageously comprises a turning station for turning the containers upstream of the filling station in the transport direction. In this way, the containers can be turned from a first orientation in the holding elements into an orientation in the holding elements opposite the first orientation.

For turning, the containers are, for example, removed from the holding elements by means of the turning station and are subsequently inserted into them again.

The at least one processing station advantageously comprises a closing station, which is arranged upstream of the turning station in the transport direction, for closing the containers with closing elements. Accordingly, two closing stations can be provided. In particular, carpules are closed at the first closing station on a first side, whereupon the containers are turned. After filling, the containers are closed on the second side.

The at least one processing station preferably comprises, upstream of the closing station of the preceding paragraph in the transport direction, a further turning station for turning the containers. Via the further turning station, the containers can be turned from a first orientation in the holding elements into an orientation opposite the first orientation in the holding elements. Accordingly, it can be provided to turn the containers twice along the transport segment and to close them in between.

Alternatively, it may be provided that the containers can be coupled into the transport segment "upside down" as it were, closed on one side and subsequently only turned once, whereupon they can be filled and then closed on the other side.

It can be provided that the apparatus comprises a further closing station for closing the containers with closing elements upstream of the transport device in a feed direction. The containers can, for example, be closed on one side and then coupled into the transport segment.

The apparatus preferably comprises a further transport device which is designed correspondingly to the transport device, and to which the containers can be transferred via transport elements of the apparatus, as well as at least one further processing station for processing the containers. The above explanations with respect to the transport device can be accordingly applied to the further transport device. The further transport device can be arranged on the same frame or on a further frame of the apparatus.

The at least one further processing station comprises, for example, a monitoring station for checking a correct seat of a closing element on the respective container. In the case of a negative determination, the container can be discharged, for example.

Alternatively or additionally, the at least one further processing station preferably comprises a closing station for attaching a closing element to the already closed containers. In this case, the closing station is used in particular in connection with already closed vials in order to place crimp caps on the containers.

A crimping station for crimping the crimp caps is preferably provided.

The apparatus advantageously comprises at least one isolator device, which covers at least one frame, with a cover element, preferably for providing an atmosphere and/or for decontamination purposes between the cover element and the frame, and for example for applying the atmosphere to the containers. The cover element can cover the frame and preferably extend by side walls up to the frame.

The filling device preferably has an independent or separate isolator device. The filling of the containers can in this way be carried out under an atmosphere for protection and/or for decontamination purposes with protective gas. In particular, the filling device is thereby also suitable in particular for filling the containers with toxic or highly sensitive pharmaceutical substances.

Instead of an isolator device, hood-shaped machine protection with glass or plastic panes can, for example, be provided for covering the at least one frame.

As explained above, the present disclosure further relates to a filling device for filling pharmaceutical containers.

A filling device in accordance with the present disclosure for filling pharmaceutical containers, which can in particular be a component of one of the apparatuses described above, comprises

- a frame which can be positioned on a set-down surface and has a surface, a first side and a second side opposite thereto,
- at least one processing station for the containers which comprises a filling station for filling the containers with a pharmaceutical substance,
- a transport device, which is arranged between the first side and the second side and is in particular linear, with circulating holding elements for the containers which move along a transport direction from a coupling side to a decoupling side on a transport segment and counter to the transport direction on a return segment, wherein the filling station is arranged on the transport segment, and the transport segment and the return segment define a transport plane of the transport device and are arranged above the surface, and wherein the transport plane is inclined by an angle of inclination relative to a plane of the surface and/or a horizontal plane, and the transport segment is arranged above the return segment in the direction of gravity.

The advantages which were already mentioned in connection with the explanation of the apparatus can also be achieved with the filling device. Advantageous embodiments of the filling device result from advantageous embodiments of the apparatus as already explained. The filling device can have the features of these embodiments.

Preferred embodiments of the apparatus in accordance with the present disclosure for processing pharmaceutical containers and preferred embodiments of the filling devices in accordance with the present disclosure for filling pharmaceutical containers are described below with reference to the drawing. Identical or functionally equivalent features and components are used with the same reference numerals in each case.

First preferred embodiments of the apparatus and of the filling device are discussed first with reference to FIGS. 1 to 8. The explanations with respect to these embodiments apply in a corresponding manner to the subsequently explained embodiments. The advantages that can be achieved using the embodiments explained first can also be achieved with the embodiments explained subsequently. For this reason, the embodiments explained subsequently are described with reference to the respective basic differences from the embodiments of FIGS. 1 to 8. In all other respects, the explanations made with respect to them apply.

In the present example, pharmaceutical containers comprise in particular vials (also referred to as bottles or phials), syringes and/or carpules. The containers are processed with the apparatus, in particular filled using the filling device.

Figures 5, 6:
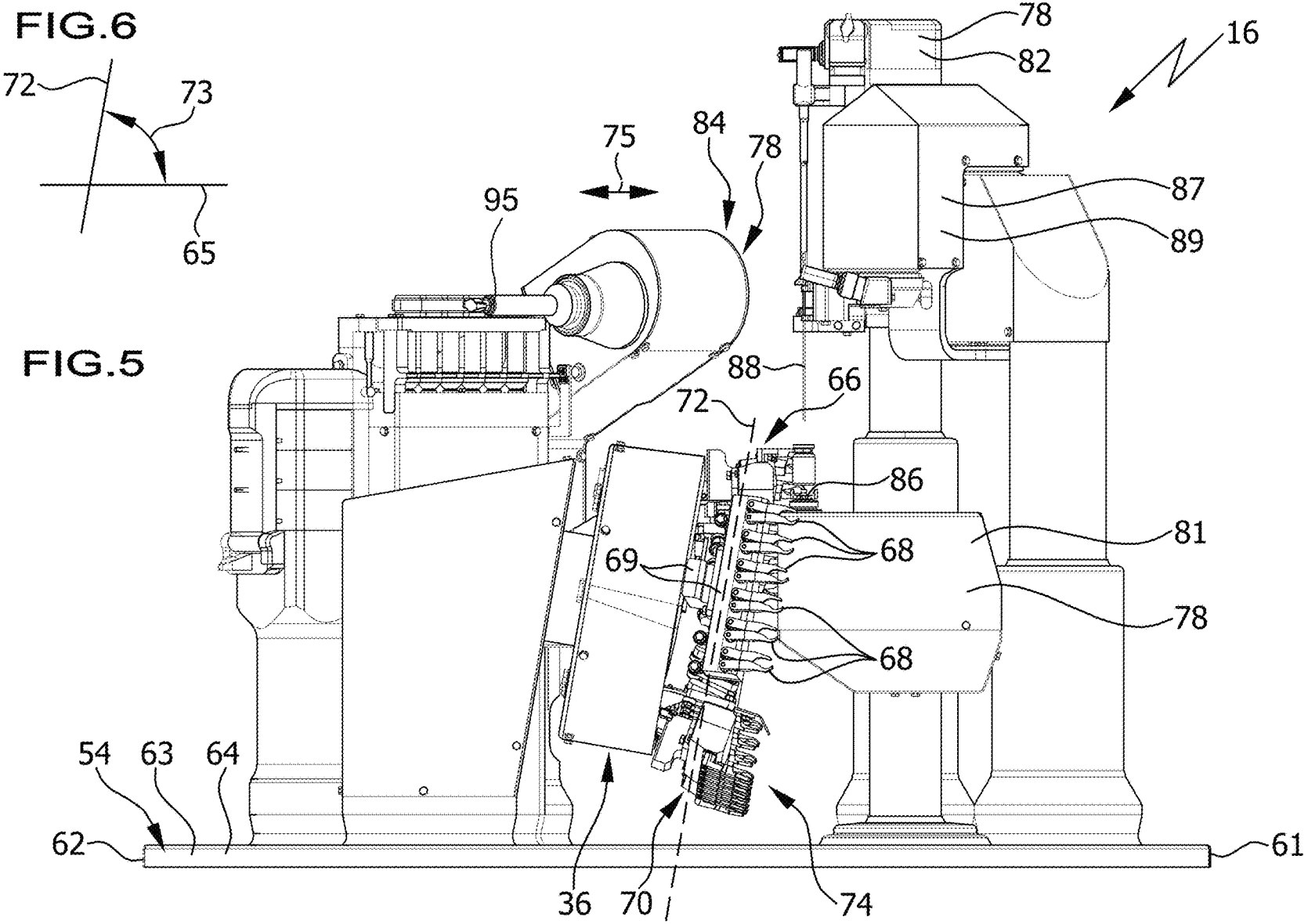
FIG. 5: shows a view of the filling device with the omission of components in the viewing direction of the arrow "5" in FIG. 3.
FIG. 6: shows a representation which symbolizes an angle of inclination of a transport plane of the filling device relative to a surface plane and/or a horizontal plane.
Figure 7:
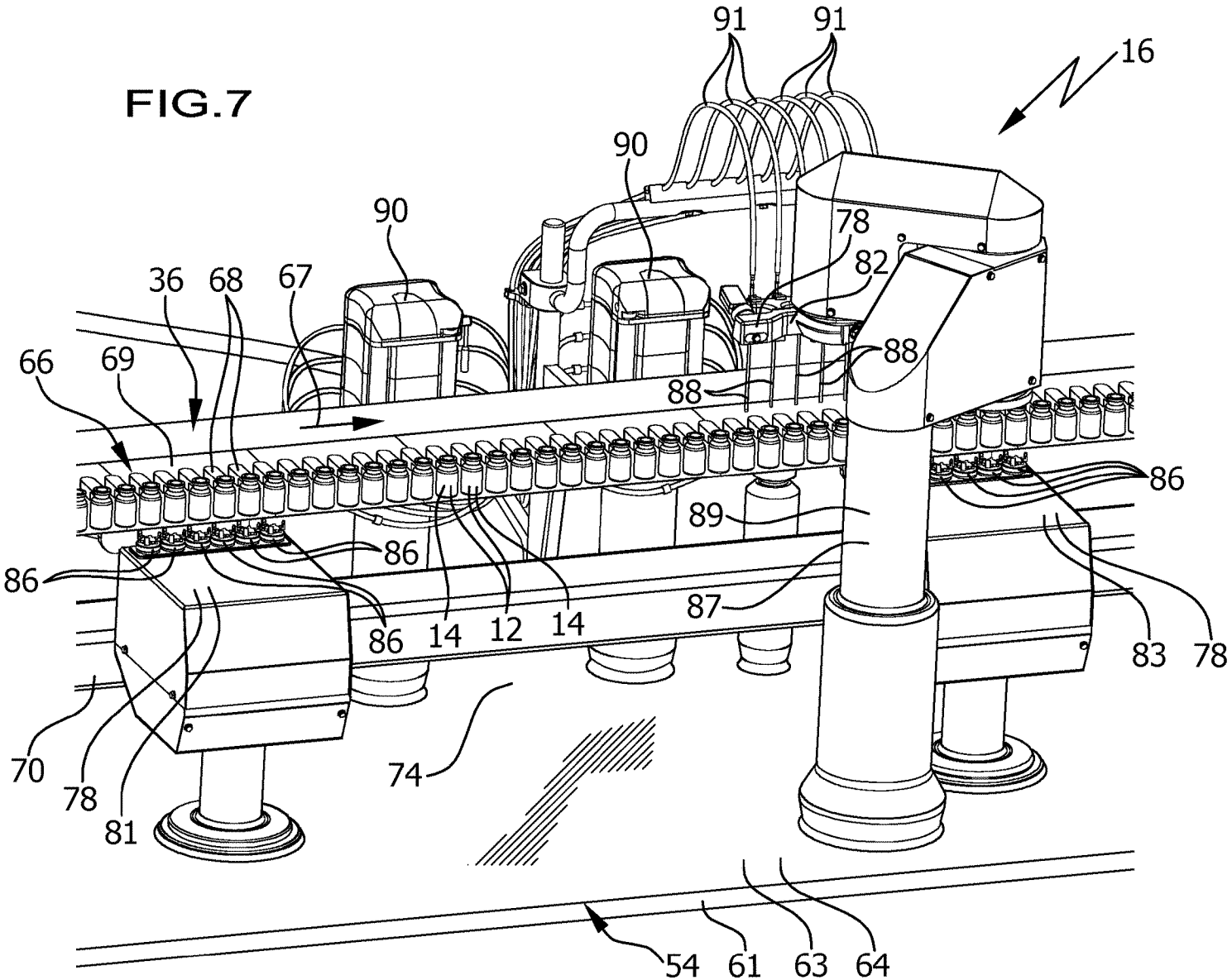
FIG. 7: shows an enlarged representation of a partial region in accordance with detail C in FIG. 3.

FIG. 1 shows a schematic representation, a so-called layout, of an advantageous embodiment of the apparatus in accordance with the present disclosure for processing containers 12, which embodiment is overall assigned the reference numeral 10. By way of example, FIGS. 5 and 7 show containers 12 in the form of vials 14.

The apparatus 10 comprises a preferred embodiment of the filling device in accordance with the present disclosure, which is depicted with reference numeral 16 and shown in a detail view in FIGS. 3 to 5 and 7. The filling device 16 may also be referred to as a "filling machine."

Furthermore, the apparatus 10 comprises a first feed unit 18 and a second feed unit 20 upstream of the filling device 16 in the feed direction of the containers 12.

Downstream of the filling device 16 in a decoupling direction for the containers 12, the apparatus 10 comprises a first removal unit 22 and a second removal unit 24.

The feed units 18, 20 are provided for providing and feeding containers 12 of different types. The removal units 22 and 24 are provided for the removal of the containers 12 as desired for further processing.

In the present case, the "type" of the containers 12 is determined in particular by the shape of the containers being provided by the feed units 18, 20. The first feed unit 18 is designed to provide containers 12 as bulk goods ("bulk"). The containers 12 are picked up separately by a transport element in the form of a turntable 26 and are fed to an interface element 28, for example indirectly via a further transport element 27.

An element 29 is schematically represented in the drawing upstream of the turntable 26. This element is a placeholder for further components of the feed unit 18, for example, and preferably in this sequence: a washing device, a sterilization device and/or a drying device for the containers 12.

The second feed unit 20 is provided for processing so-called RTU (ready-to-use) containers and is designed to remove the containers 12 from a common carrier 30, which can also be referred to as a "nest." For removal, a handling device 31 is used, from which the containers 12 can, for example, be fed via at least one further transport element 32, 33 to the interface element 28.

In the present example, the transport elements 27 and 33 are transport wheels, and the transport element 32 is a cell chain by means of which the containers 12 are separately transported further.

In the present case, the interface element 28 is a transport wheel and is in particular arranged at an interface position 34. Depending on whether the containers 12 are provided as bulk goods or via the carrier 30, the containers to be processed can selectively be introduced into the filling device 16 via the interface element 28. The containers 12 are introduced separately in both cases.

The filling device 16 is dimensioned such that, in a transport device 36 to be explained below, a distance 37 of adjacent containers 12 from one another is the same, regardless of the type of containers 12, and the type and size of the containers to be processed (within the scope of use of the apparatus). This distance ("machine pitch") is defined by the distance between receptacles of holding elements of the transport device 36.

Containers 12, which are introduced by the first feed unit 18, are picked up by the turntable 26 such that the distance is already set to the machine pitch.

When feeding containers 12 from the second feed unit 20, it is preferably possible to set the distance of the containers 12 to the distance 37 by means of the handling device 31.

If a distance 38 of the containers 12 in the carrier 30 ("nest pitch") deviates from the distance 37, the distance can be adapted, for example, by means of the handling device 31 described in the non-prepublished patent application DE 10 2020 134 783.9 by the same applicant. The entire disclosure of this patent application is incorporated in its entirety in the present patent application.

The use of a constant machine pitch offers the advantage of a structurally simple and compact design of the apparatus 10, in particular of the filling device 16.

Nevertheless, the apparatus 10, in particular the filling device 16, can have a plurality of format sets 39. FIG. 1 shows, by way of example, two format sets 39.

A respective format set 39 has container-specific, container-component-specific or processing-specific format parts which, if necessary, can be replaced in the apparatus 10 in order to be able to process the desired containers 12. With regard to holding elements and holding element carriers of the transport device 36, however, the format parts of the format sets 39 do not differ in that receptacles for the containers 12 of the holding elements are each formed in the different format sets so as to ensure the constant machine pitch.

It is understood that the transport elements for containers 12, in particular the transport wheels, can also be format parts.

In the present example, the interface element 28 is likewise a transport wheel and can be a format part. The use of only exactly one interface position for introducing containers 12 into the filling device 16 is advantageous.

On the output side of the filling device 16, processed containers 12 are received by an interface element 40, configured as a transport wheel, at exactly one interface position 41 in the present example.

The containers 12 processed by the filling device 16 can selectively be transferred to the first removal unit 22 or to the second removal unit 24. The first removal unit 22 is discussed below with reference to FIG. 8. For example, FIG. 1 shows, after the interface element 40, first transport elements 42, 43, a transport device 44 and, thereafter, further transport elements 45 and 46. The transport elements 42, 43, 45 and 46 are transport wheels in the present case; their number is symbolic and exemplary in the present example.

The machine pitch of the removal unit 22 and in particular of the transport device 44 is preferably identical to the machine pitch of the filling device 16.

In functional terms, the second removal unit 24 is configured at least partially corresponding to the second feed unit 20 and comprises, for example, a transport element 47 in the form of a transport wheel and, thereafter, a transport element 48 in the form of a cell chain. By means of a further handling device 49, the fed containers 12 can be conveyed into the carrier 30, which, when previously emptied, can preferably be fed (arrow 50) from the feed unit 20 via a conveying device not shown in the drawing.

When the containers 12 are placed in the carrier 30, the distance 37 between the containers 12 is reset by means of the handling device 49 to the nest pitch with the distance 38.

It is understood that the components of the removal units 22, 24 can also have format parts from one of the format sets 39.

Depending on the desired type of further processing, containers 12 of the first or second type can be transferred to the removal unit 22 or to the removal unit 24.

The apparatus 10 comprises a control device 52 for controlling the operation of the apparatus and also the filling device 16.

It is understood that the apparatus 10 has drive devices for the respectively active components. These drive devices are not shown in the drawing and are not explained. Such drive devices are known to the person skilled in the art.

In the apparatus 10, separate frames 54 are provided for the filling device 16, the feed units 18, and the removal units 22, 24. The frames 54, which can also be referred to as a substructure or a "table," can be positioned on a set-down surface 55, for example the floor of a laboratory or of a hall. A clean room environment or a clean room atmosphere is preferred.

It is advantageous for the filling device 16 to comprise an independent frame 54. This makes it possible to form apparatuses in accordance with the present disclosure with the filling device 16 in accordance with the present disclosure in a substantially standardized design, which apparatuses differ from one another on the feed side or on the output side by the feed units 18, and/or the removal units 22, 24. This also offers the possibility of easy scaling and/or a modular structure of the apparatuses. This has also proven advantageous in terms of the production costs of the apparatuses due to the possibility of using standardized components. The training effort and the maintenance effort can be reduced.

Furthermore, at least one isolator device 56 is provided in the apparatus 10 and comprises a cover element 57 for covering the respective frame 54. In this case, the frame 54 is covered on the upper side by means of the cover element 57, which moreover comprises side walls. It is understood that maintenance openings may be present.

The provision of an independent frame 54 for the filling device 16 also in particular makes it possible, in combination with an independent isolator device 56 (FIG. 3), to carry out the filling of the containers 12 in a protective atmosphere and/or an atmosphere for decontamination purposes with a protective gas, in particular $H_2O_2$. For this reason, the filling device 16 is in particular also suitable for filling the containers 12 with toxic or highly sensitive pharmaceutical substances.

Figure 3:
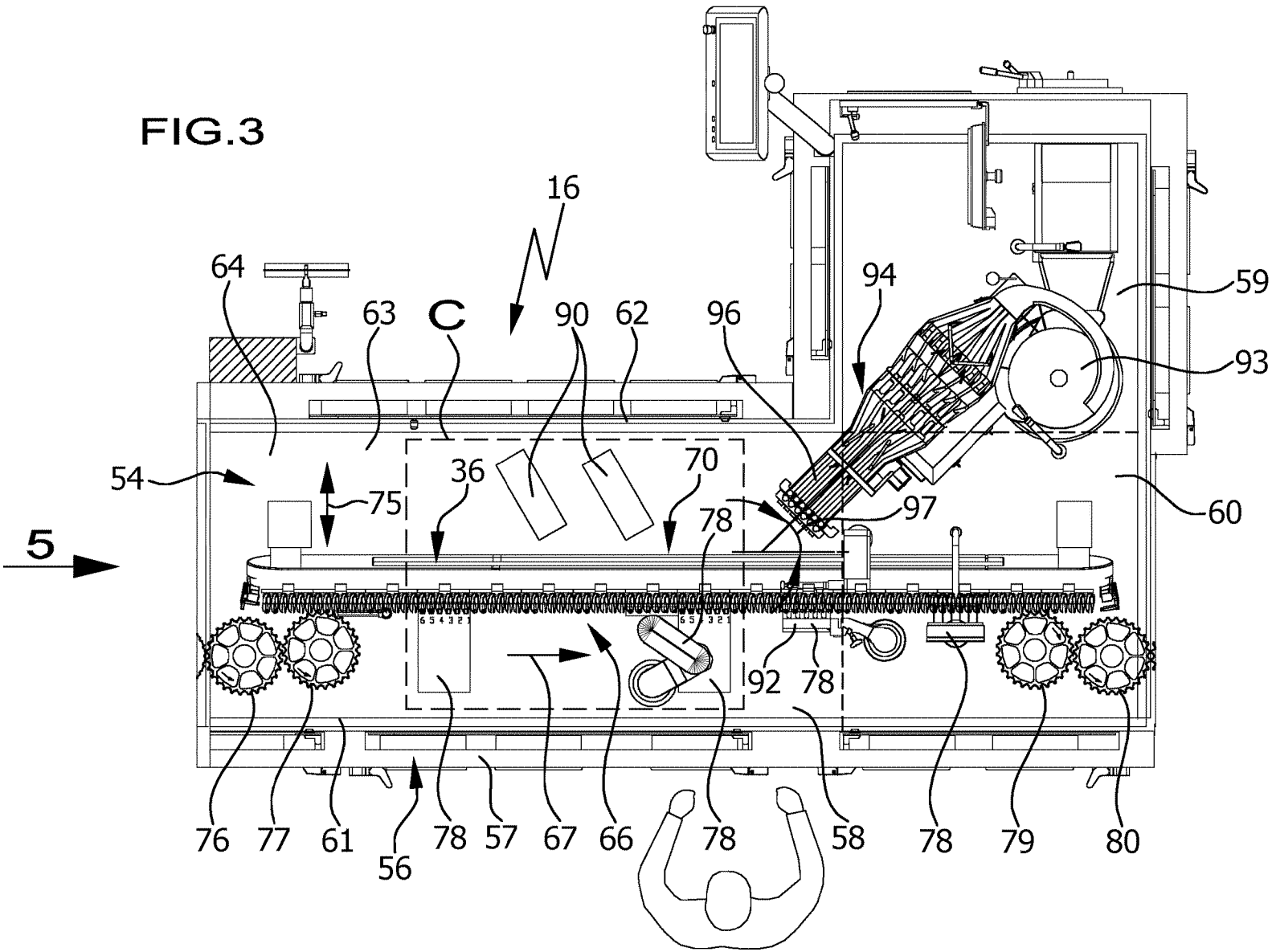
FIG. 3: shows an enlarged non-schematic and simplified representation of the filling device in accordance with detail A.

As can be seen in particular from FIG. 3, the frame 54 of the filling device 16 is substantially L-shaped in plan view and comprises a first leg 58 and a second leg 59. The legs 58, 59 cross one another at a crossing region 60. In the present case, the angle between the legs 58, 59 is 90°.

The frame 54 has a first side 61, which extends along the first leg 58, and a second side 62. The second side 62 is opposite the first side 61 with respect to a surface 63 of the frame 54. The first side 61 is a longitudinal side of the frame 54. Due to the L-shape, the second side 62 is provided with a step. The sides 61, 62 extend parallel to one another.

The surface 63 is defined by a set-down element 64 of the frame 54, which in the present case is plate-shaped. The surface 63 defines a plane 65. The plane 65 is oriented parallel to a plane of the set-down surface 55 and in particular is oriented horizontally.

The already mentioned transport device 36 is a linear transport device. It has a transport segment 66 along which the containers 12 can be transported in a transport direction 67.

For receiving the containers 12, the transport device 36 comprises holding elements 68, configured in the present case as holding tongs. A plurality of holding elements 68 is held on a respective holding element carrier 69, in the present example six each.

The transport device 36 is a circulating transport device, wherein the holding elements 68 with the circulating holding element carriers 69 move without containers along a return segment 70 counter to the transport direction 67.

The transport segment 66 and the return segment 70 are oriented parallel to one another and are each oriented parallel to the first side 61 and to the second side 62.

The transport segment 66 is less distant from the first side 61 than from the second side 62. The return segment 70 is arranged approximately in the middle between the first side 61 and the second side 62.

As can be seen in particular from FIG. 5, the transport segment 66 and the return segment 70 define a transport plane 72 of the transport device 36. For example, the transport plane is defined by the holding element carriers 69 with the holding elements 68, which are each located within the transport segment 66 or the return segment 70.

At the filling device 16, the transport plane 72 is inclined by an angle of inclination 73 relative to a horizontal plane and relative to the plane 65 of the surface 63 (FIGS. 5 and 6). In the present case, the angle of inclination 73 is approximately 80°.

Figure 4:
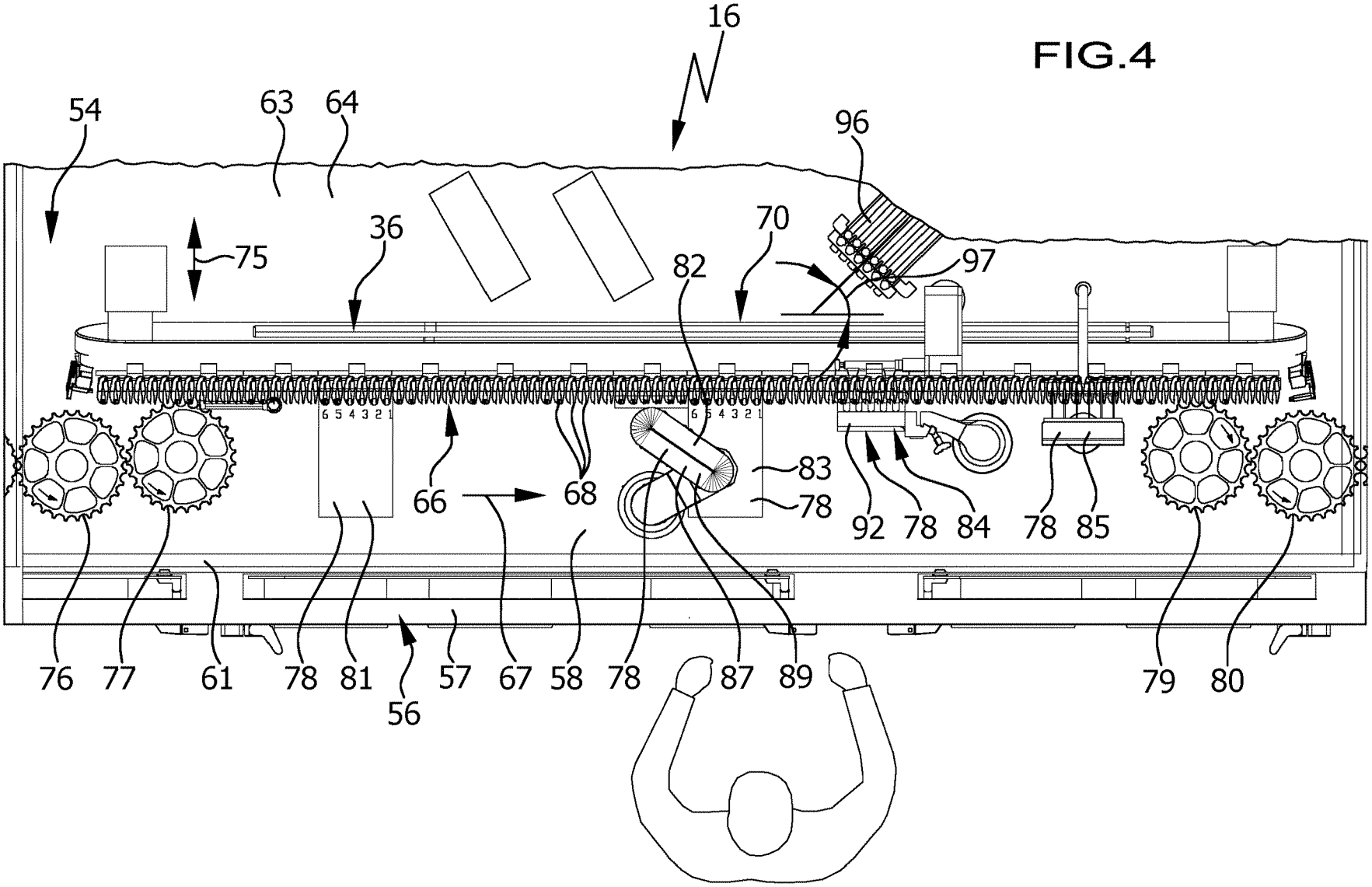
FIG. 4: shows an enlarged partial representation of the filling device in FIG. 3.

With respect to the first side 61, the transport device 36 is in this way inclined "backward" in the direction of the second side 62. In this case, the transport segment 66 is arranged above the return segment 70 in relation to the direction of gravity. It is understood that the return segment 70 is laterally offset in plan view with respect to the transport segment 66, in the direction of the second side 62 (FIG. 4).

Both the transport segment 66 and the return segment 70 are arranged above the surface 63 and thus completely within an outer contour of the frame 54. This makes it possible, in particular, to cover the frame 54 on all sides by means of the isolator device 56, in particular along the outer contours of the frame 54.

A free space 74 is arranged below the transport segment 66. The return segment 70 is arranged outside the free space 74 laterally offset in the direction of the second side 62 as mentioned.

Due to the inclination of the transport device 36, a particularly compact design of the filling device 16 can be achieved in a transverse direction 75 of the frame 54, transversely to the transport direction 67. For example, this makes it easier to, in particular, access components of the filling device 16 for maintenance purposes, for example when changing the format sets 39. The components of the filling device 16 can be accessed in a user-friendly manner both from the first side 61 and from the second side 62.

The positioning of the return segment 70 outside the free space 74 also offers the advantage that no damage to the holding elements is possible in the event of a falling container 12 or that the holding elements 68 on the return segment 70 cannot be contaminated in the event of dripping pharmaceutical substance. For this reason, the filling device 16 also has greater operational safety. This has proven advantageous in particular when processing toxic pharmaceutical substances.

In the present preferred example, the holding element carriers 69 are arranged such that the containers 12 held suspended on the holding elements 68 are transported on the transport segment 66 above the free space 74 in a vertical orientation.

Starting from the interface element 28, the containers 12 are fed to the transport device 36 via an introduction element 76 for introduction into the filling device 16 and via a coupling element 77. The introduction element 76 and the coupling element 77 are transport wheels in the present case. The coupling element 77 is arranged on a coupling side of the transport device 36 and in particular of the transport segment 66.

The transport device 36 is cycle-based; in this case, the six containers 12 on a holding element carrier 69 are in each case processed together at the plurality of processing stations 78 of the filling device 16. A respective cycle time is a few seconds, for example approximately 2 to 4 seconds. The cycle times of the processing stations 78 are preferably the same.

A decoupling element 79 for receiving the containers 12 is arranged on a decoupling side of the transport device 36 and in particular of the transport segment 66. The decoupling element 79 is followed by a discharge element 80 for discharging the containers 12 from the filling device 16. The decoupling element 79 and the discharge element 80 are transport wheels in the present case.

A first weighing station 81, a filling station 82, a second weighing station 83, a closing station 84 and a monitoring station 85 are provided as processing stations 78 of the filling device 16 in the transport direction 67.

In the present case, the weighing stations 81 and 83 are configured identically and serve to determine the tare weight before, or the gross weight after, the containers 12 have been filled in the filling station 82.

A respective weighing station 81, 83 comprises weighing elements 86 which engages in the free space 74. The weighing elements 86 are arranged below the containers 12 and can be abutted against them from below. When abutted, the holding elements 68 can be opened so that the containers 12 rest on the weighing elements 86.

The filling station 82 comprises a handling device 87 on which is held a plurality of filling elements 88 in accordance with the number of locations on the holding element carrier 69. The handling device 87 is configured as a horizontal articulated arm robot 89 in particular, a so-called Scara robot.

The filling station 82 further comprises metering units 90 for feeding to the filling elements 88 a liquid pharmaceutical substance to be filled. In the present case, two metering units 90 are provided for supplying the six filling elements 88.

In the case of underfilling, the containers 12 can be refilled by means of the filling station 82. For this purpose, the filling elements 88 are preferably positioned above the containers 12 on the weighing station 83, and the containers 12 are refilled on the weighing station 83.

The handling device 87, like the weighing stations 81 and 83, are arranged between the transport segment 66 and the first side 61 and, as a result, can be easily reached for maintenance purposes. The metering units 90 are arranged between the return segment 70 and the second side 62 and can likewise be easily reached for maintenance purposes. Fluid conduits 91 from the metering units 90 to the filling elements 88 are guided over the transport device 36.

The closing station 84 comprises a lowering unit 92, a storage unit 93, a feed unit 94 and a receiving unit 95. The lowering unit 92 is arranged between the transport segment 66 and the first side 61 and can in this way be easily reached for maintenance purposes. The storage unit 93 and the feed unit 94 are arranged between the return segment 70 and the second side 62 and can in this way be easily reached for maintenance purposes.

The storage unit 93 is preferably designed without a format and, for example, as a pot which is arranged on the second leg 59 outside the crossing region 60. From the storage unit 93, the closing elements stored therein for closing the containers 12 reach the feed unit 94. Depending on the type of containers 12, the closing elements can, for example, be mushroom plugs or plungers.

The feed unit 94 comprises a plurality of feed paths, wherein a feed path 96 is associated with each location of the holding element carrier 69. The closing elements are separated within each feed path 96.

The feed unit 94 extends in sections through the crossing region 60 (FIG. 3). Such a positioning of the components of the closing station 84 facilitates the compact design of the filling device 16.

The feed units 94 are oriented at an angle 97 with respect to the transport direction 67. In the present example, the angle 97 is approximately 40° to 60°.

At the end of the feed paths 96, the closing elements are received by means of the receiving unit 95 and fed via the latter over the transport device 36 to the lowering unit 92. Received by the lowering unit 92, the closing elements can be lowered in the direction of the containers 12 in order to close the latter.

At the monitoring station 85, the presence of closing elements on the containers 12 is checked. If the closing element is missing, the corresponding container 12 can be discharged, for example via the removal units 22, 24. The monitoring station 85 is arranged between the transport segment 66 and the first side 61 and can in this way be easily reached for maintenance purposes.

In the filling device 16, 100% monitoring can be achieved during ongoing operation (IPC, in-process control).

Figure 8:
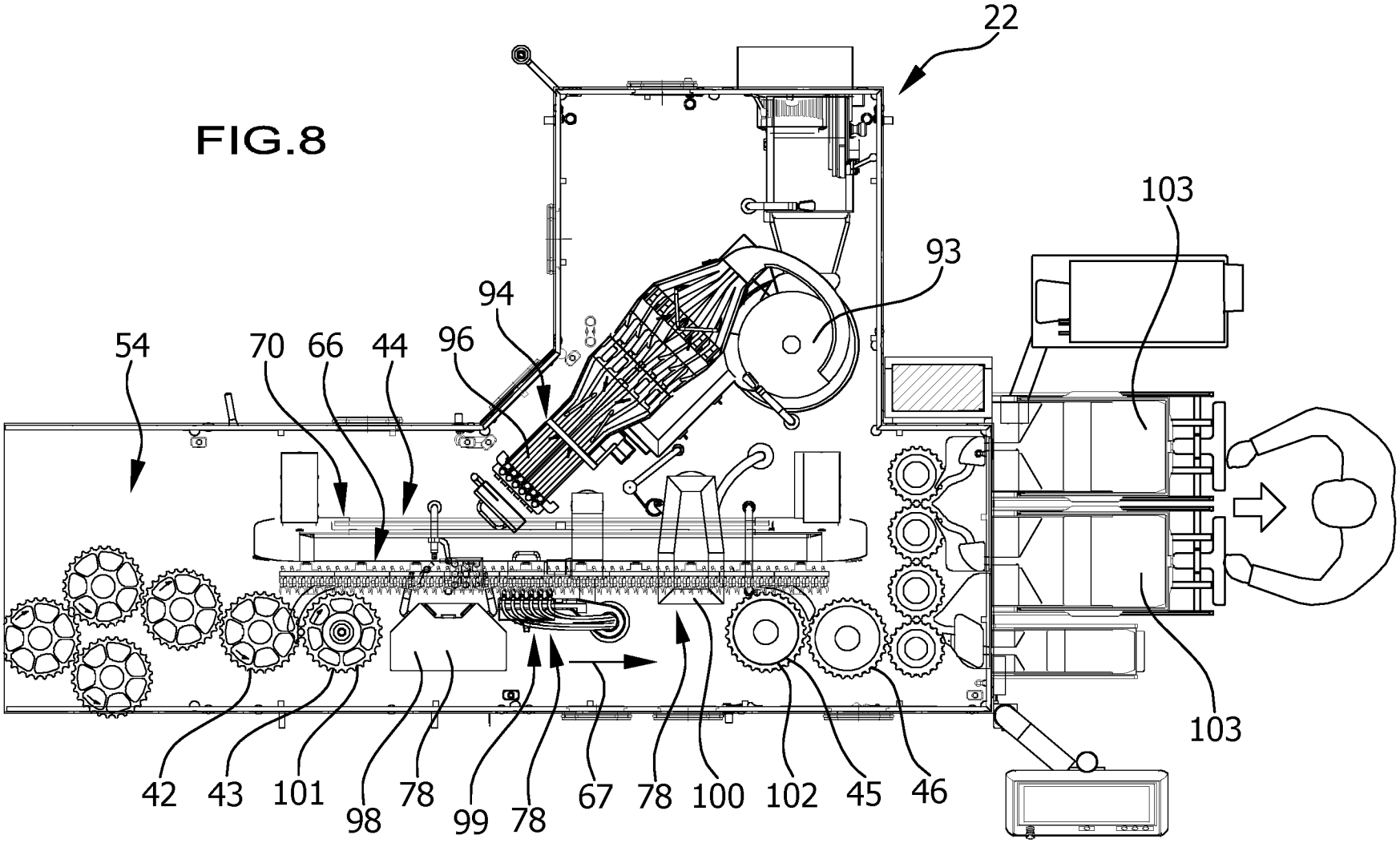
FIG. 8: shows an enlarged representation of a removal unit of the apparatus from FIG. 1 in accordance with detail B in a non-schematic, simplified representation.

With reference to FIG. 8, the configuration of the first removal unit 22 is now explained in more detail.

The apparatus 10 comprises the further transport device 44 already mentioned, which is used in particular for the further processing of containers 12. In this case, the containers 12 fed from the bulk via the first feed unit 18 or fed from the second feed unit 20 can be processed.

The transport device 44 is constructed corresponding to the transport device 36 and works in a corresponding manner so that reference can be made in this respect to the above statements. In particular, in the transport device 44, the transport plane 72 is also inclined relative to the horizontal plane and to the plane 65 by an angle of inclination that is preferably identical to the angle of inclination 73.

A monitoring station 98, a closing station 99 and a crimping station 100 are arranged on the transport device 44 as further processing stations and are positioned in this order along the transport direction 67.

The monitoring station 98 checks whether the containers 12 are correctly closed by means of the closing elements, i.e., the correct seat of the closing elements is checked. In the event of a negative determination, the corresponding container 12 can be discharged, for example.

The closing station 99 is used to place crimp caps on already closed containers 12, in particular vials. In functional terms and with respect to the arrangement of the respective components, the closing station 99 is configured corresponding to the closing station 84 (FIG. 8). Reference is made to the above statements.

The placed crimp caps can be crimped at the crimping station 100.

The transport element 43 schematically represented in FIG. 1 forms a coupling element 101 for the transport device 44; the decoupling is performed via a decoupling element 102 formed by the transport element 45 shown by way of example.

The processed containers 12 can be transferred into receiving units 103 on the output side of the first removal unit 42. This can be referred to as "storing."

In the schematic layout of the apparatus 10 in FIG. 1, the frame 54 of the feed unit 18 is arranged flush with the frame 54 of the filling device 16. The feed unit 20 is connected transversely and in particular perpendicularly to the feed unit 18.

By using separate frames 54, the components of the apparatus 10 can, as mentioned, be adapted in a versatile and structurally simple manner to the respective requirements, in particular when using a separate frame 54 for the filling device 16.

Figure 9:
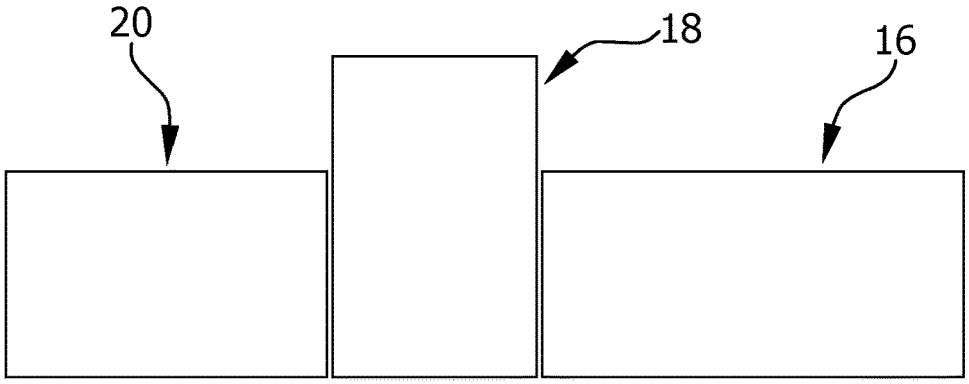
FIGS. 9 to 11: show schematically portrayed partial regions of the apparatus in accordance with the present disclosure.

FIG. 9 shows an example in which the frames 54 of the feed unit 20 and of the filling device 16 are arranged flush. The feed unit 20 is connected to the feed unit 18 which is arranged transversely, and in particular perpendicularly, to the alignment and in turn is connected to the filling device 16.

Figure 10:
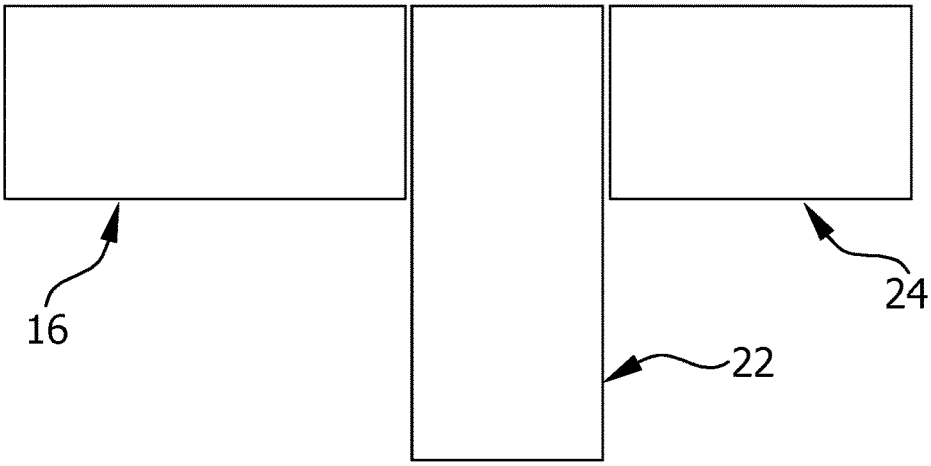

FIG. 10 shows, by way of example, a possibility of the different arrangement of the removal units 22, 24 on the output side of the apparatus. In this case, the frames 54 of the filling device 16 and of the second removal unit 20 are arranged flush. The first removal unit 22 adjoins the filling device 16 and is oriented transversely and in particular perpendicularly to the alignment. The second removal unit 24 adjoins the first removal unit 22.

Figure 11:
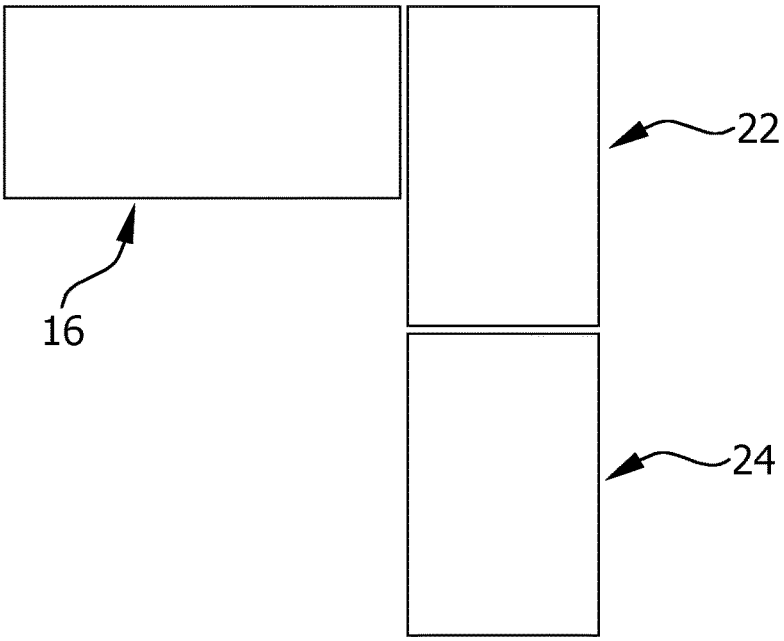

In the configuration in accordance with FIG. 11, the position of the second removal unit 24 is changed in comparison to the configuration in accordance with FIG. 10, such that the frames 54 of the removal units 22, 24 are arranged flush with one another. In this case, the containers 12 to be transferred back into the carrier 30 can in particular run through the removal unit 22 first, for example the transport device 44, wherein the processing stations 78 arranged thereon remain unused.

Figure 12:
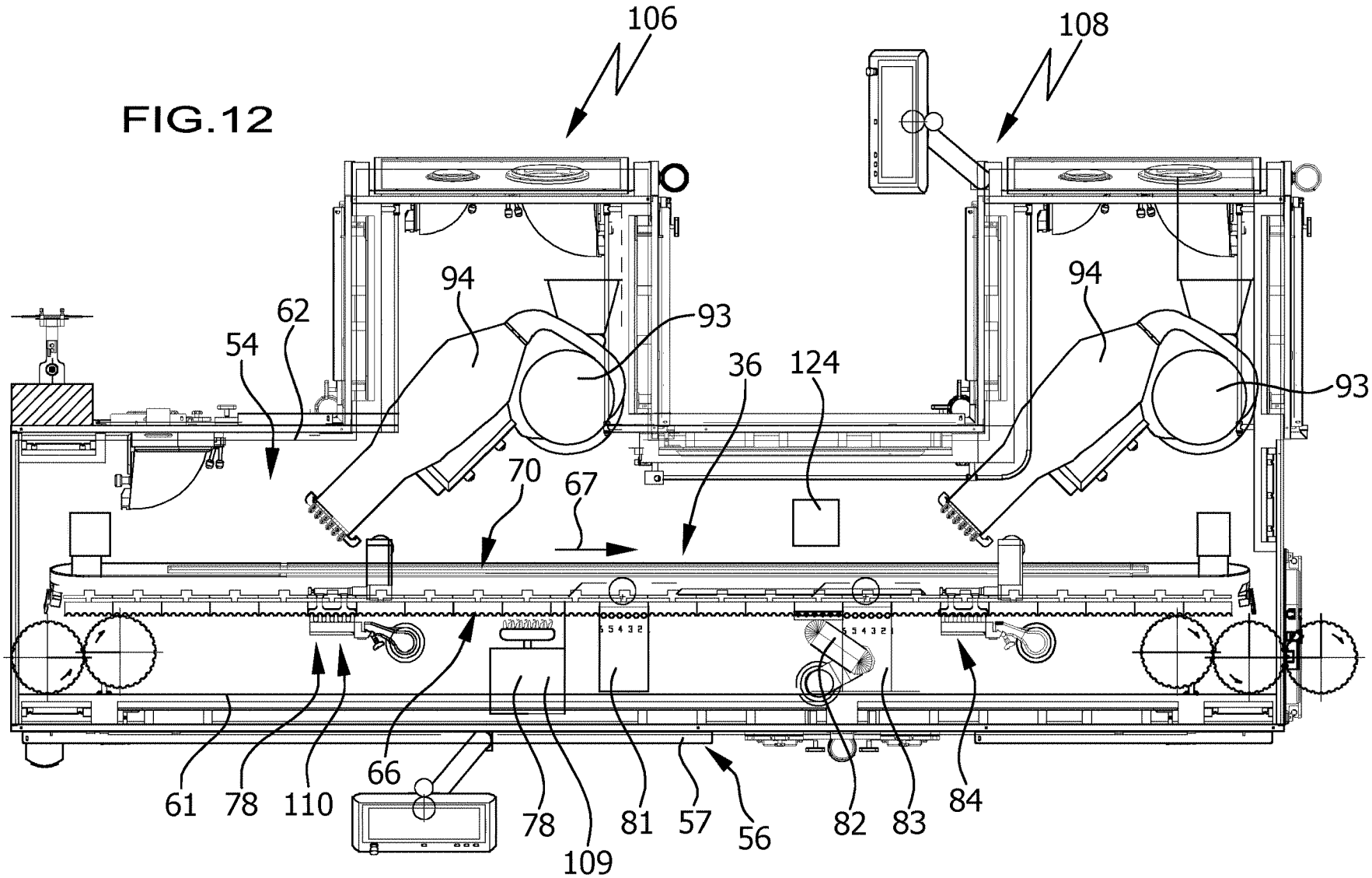
FIG. 12: shows a further embodiment of the apparatus in accordance with the present disclosure comprising a further embodiment of the filling device in accordance with the present disclosure.

FIG. 12 shows an apparatus 106 in accordance with the present disclosure with a filling device 108 in accordance with the present disclosure.

In the filling device 108, in the transport direction 67, a closing station 110 is arranged upstream of a turning station 109, which in turn is arranged upstream of the weighing station 81. With respect to the closing station 110, reference is made to the explanations regarding the closing station 84.

In the filling device 108, the containers 12, in particular carpules, are coupled upside down into the transport segment 66. At the closing station 110, one side of the containers 12 is closed first. Subsequently, the containers 12 are turned by means of the turning station 109 and processed further as explained with reference to the example of the filling device 16.

Figure 13:
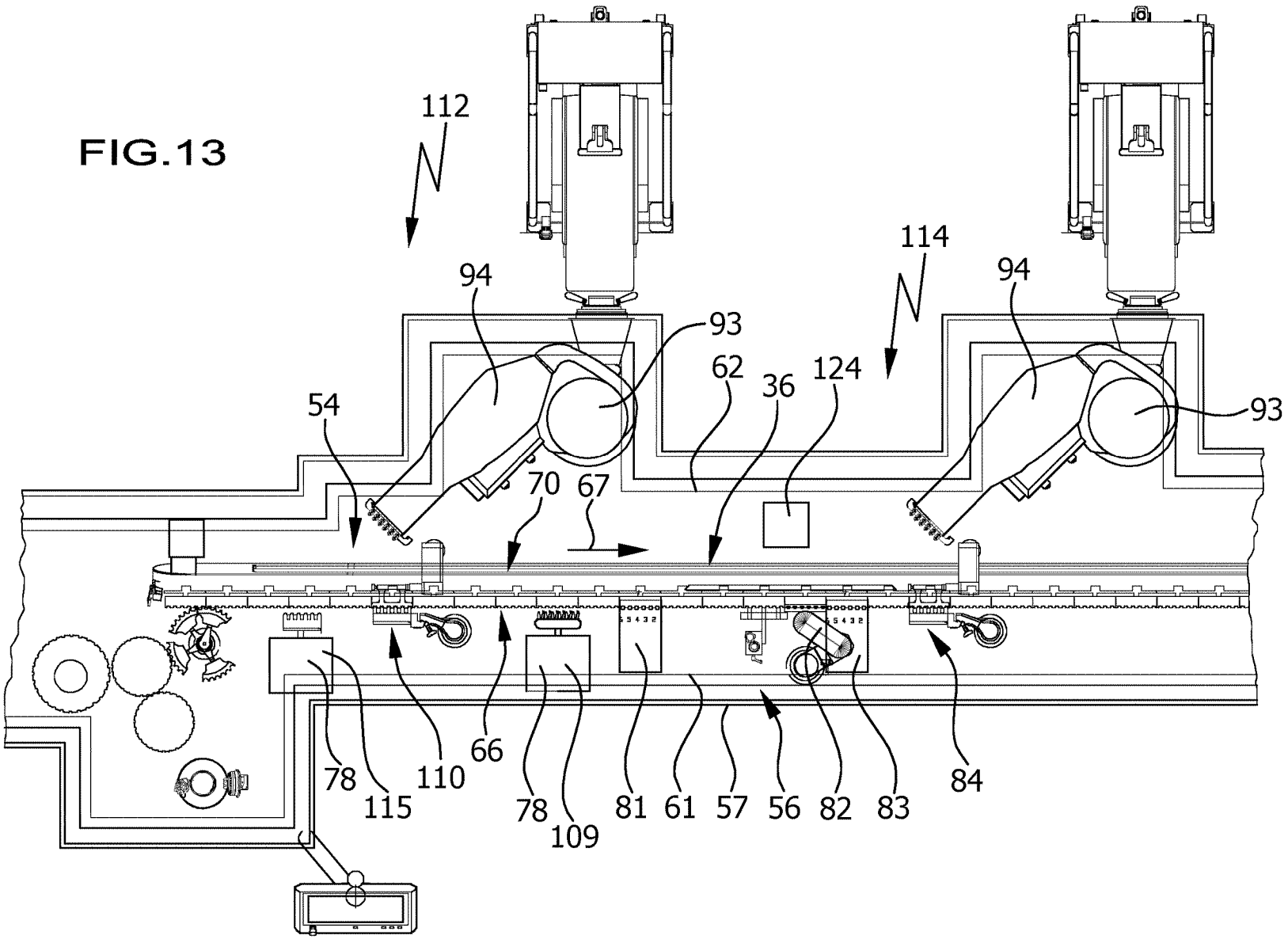
FIG. 13: shows a further embodiment of the apparatus in accordance with the present disclosure comprising a further embodiment of the filling device in accordance with the present disclosure.

FIG. 13 shows a partial representation of an apparatus in accordance with the present disclosure with the reference numeral 112 with a filling device 114 in accordance with the present disclosure.

In comparison to the apparatus 106, the difference of the apparatus 112 is that a further turning station 115 is provided upstream of the closing station 110 in the transport direction 67.

In the filling device 114, the containers 12, in particular carpules, are coupled into the transport segment 66 in the orientation that the containers 12 also have during filling. First, the container 12 is turned by means of the turning station 115, closed on the one side by the closing station 110, and then turned again by the turning station 109.

Figure 14:
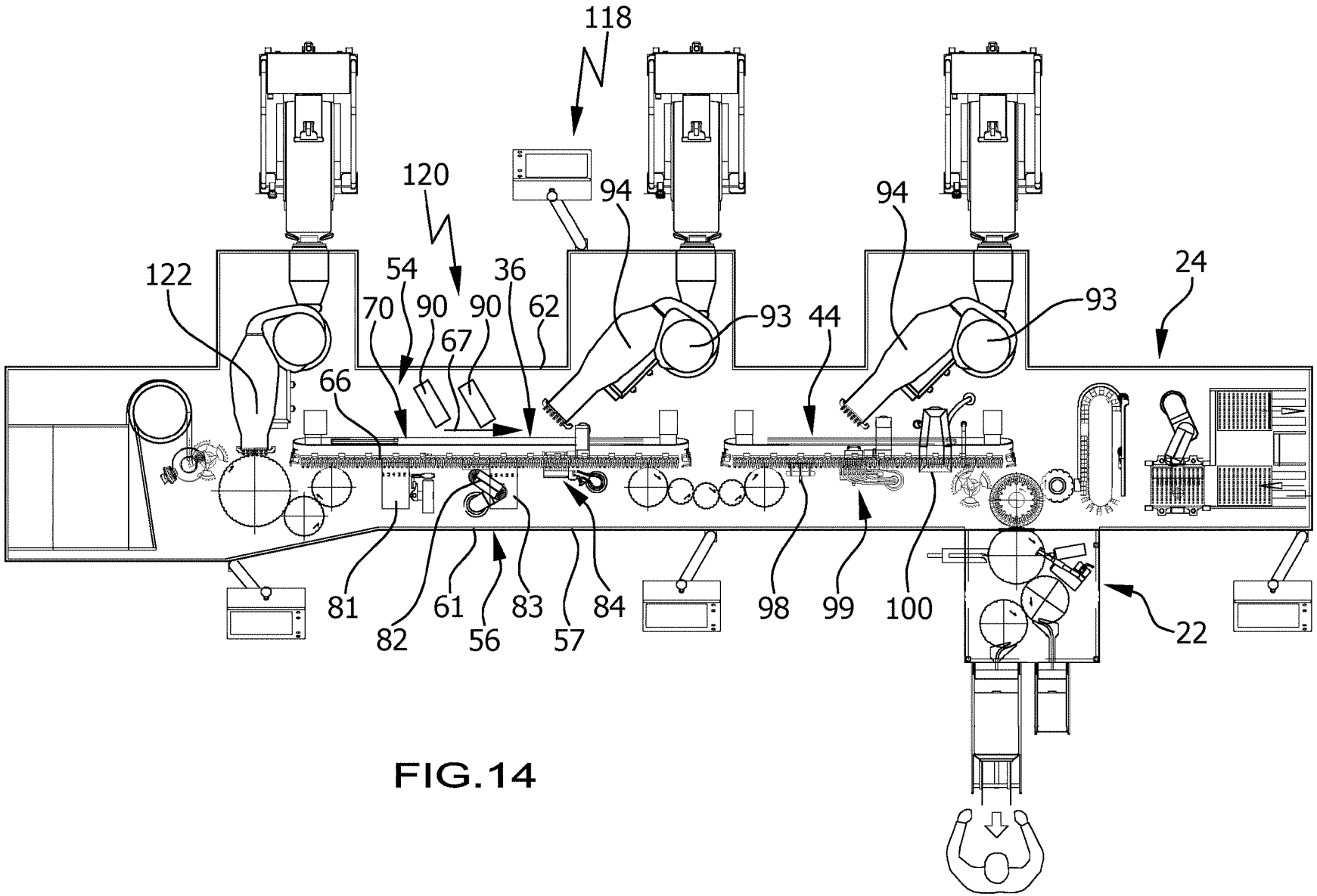
FIG. 14: shows a further embodiment of the apparatus in accordance with the present disclosure comprising a further embodiment of the filling device in accordance with the present disclosure.

FIG. 14 shows an apparatus 118 in accordance with the present disclosure with a filling device 120 in accordance with the present disclosure. In the apparatus 118, a closing station 122 is present upstream of the transport device 36 in a feed direction. At the closing station 122, containers 12, in particular carpules, can be closed on one side before they are coupled into the transport segment 66. In this case, the containers 12 are closed on the underside so that the turning stations 109 and/or 115 at the transport device 36 can be dispensed with.

In deviation from the apparatus 10, the transport device 44 in the apparatus 118 is arranged on the same frame 54 as the transport device 36 of the filling device 16.

The metering units 90 in the filling devices 16 and 120 are, for example, peristaltic pumps. FIGS. 12 and 13 schematically show, on the filling devices 108 and 114, a pump unit 124 which can be representative of a plurality of pump units, for example a pump unit 124 per location in the holding element carrier 69.

The design and mode of operation of the closing stations 84, 99 and/or 110 are preferably as described in the non-prepublished patent application DE 10 2020 134 792.8 by the same applicant. The entire disclosure of this patent application is incorporated in its entirety in the present patent application.

The invention claimed is:

1. An apparatus for processing pharmaceutical containers being vials, syringes and/or carpules, comprising:

a frame which is positionable on a set-down surface and has a surface, a first side and a second side opposite the first side;

at least one processing station comprising a weighing station for the containers; and a transport device, which is arranged between the first side and the second side, with circulating holding elements for the containers which move along a transport direction from a coupling side to a decoupling side on a transport segment and counter to the transport direction on a return segment;

wherein the at least one processing station is arranged at the transport segment, and the transport segment and the return segment define a transport plane of the transport device and are arranged directly above the surface and within an outer contour of the frame, wherein the transport plane is inclined by an angle of inclination relative to a plane of the surface and/or a horizontal plane, and the transport segment is arranged above the return segment in the direction of gravity, and wherein the transport device has a free space below the holding elements arranged in the transport segment, the holding elements arranged on the return segment being arranged outside the free space, with the weighing station for the containers engaging in the free space.

2. The apparatus in accordance with claim 1, wherein the transport device is a linear transport device.

3. The apparatus in accordance with claim 1, wherein the angle of inclination is greater than 45° and/or wherein the angle of inclination is less than 90°.

4. The apparatus in accordance with claim 1, wherein the angle of inclination is approximately 80°.

5. The apparatus in accordance with claim 1, wherein the containers held in the holding elements are transported on the transport segment above the free space, and/or wherein the return segment is arranged offset in the direction of the second side with respect to the free space.

6. The apparatus in accordance with claim 1, wherein the transport device is a cycle-based transport device and wherein the containers are processed at the at least one processing station within a predetermined or predeterminable cycle time.

7. The apparatus in accordance with claim 6, wherein the cycle times are identical in a plurality of processing stations.

8. The apparatus in accordance with claim 1, comprising a plurality of holding element carriers with a respective plurality of holding elements.

9. The apparatus in accordance with claim 1, wherein the apparatus comprises a plurality of format sets with respective format parts, wherein the format parts have holding element carriers and/or holding elements, wherein the format parts of different format sets differ from one another in a container-specific, container-component-specific and/or processing-specific characteristic, wherein a distance between container receptacles of the holding elements of different format sets is identical.

10. The apparatus in accordance with claim 1, wherein the at least one processing station comprises a filling station for filling the containers with a pharmaceutical substance, wherein the filling station comprises filling elements and a handling device for the filling elements, wherein the handling device is arranged between the transport segment and the first side.

11. The apparatus in accordance with claim 10, wherein the filling station comprises at least one pump unit and/or metering unit for feeding the substance to the filling elements, which unit is arranged between the return segment and the second side.

12. The apparatus in accordance with claim 10, wherein the weighing station is a first weighing station for weighing unfilled containers, the first weighing station arranged upstream of the filling station in the transport direction.

13. The apparatus in accordance with claim 10, wherein the apparatus is adapted to determine whether the containers are filled with a predetermined or predeterminable quantity of the substance, wherein the containers are refillable via the filling station in the event of a negative determination and insufficient filling quantity.

14. The apparatus in accordance with claim 10, wherein the at least one processing station comprises a closing station for closing the containers with closing elements, wherein the closing station is positioned downstream of a filling station in the transport direction.

15. The apparatus in accordance with claim 14, wherein the closing station comprises a lowering unit, via which the closing elements are configured to be lowered from above in the direction of the filled containers, wherein the lowering unit is arranged between the transport segment and the first side.

16. The apparatus in accordance with claim 15, wherein the closing station comprises a receiving unit for receiving separated closing elements and feeding to the lowering unit, wherein the closing elements are movable, over the transport device.

17. The apparatus in accordance with claim 14, wherein the closing station comprises a storage unit for storing closing elements and a feed unit for feeding separated closing elements, wherein the storage unit and the feed unit are arranged between the return segment and the second side.

18. The apparatus in accordance with claim 10, wherein the at least one processing station comprises a second weighing station for weighing filled containers, which is arranged downstream of the filling station in the transport direction.

19. The apparatus in accordance with claim 1, wherein 100%-monitoring during the processing of the containers is provided.

20. The apparatus in accordance with claim 1, wherein the apparatus comprises a coupling element for transferring the containers separately to the transport device and/or a decoupling element for receiving the containers separately from the transport device.

21. The apparatus in accordance with claim 20, wherein at least one of the following applies:

the apparatus comprises an introduction element which is arranged upstream of the coupling element in a feed direction, transfers the containers to the coupling element and is held on the frame;

the apparatus comprises a discharge element which is arranged downstream of the decoupling element in a decoupling direction, receives the containers from the decoupling element and is held on the frame.

22. The apparatus in accordance with claim 1, wherein the at least one processing station comprises a filling station for the containers and a turning station for turning the containers, the turning station being arranged upstream of the filling station in the transport direction and wherein the at least one processing station comprises a closing station, which is arranged upstream of the turning station in the transport direction, for closing the containers with closing elements.

23. The apparatus in accordance with claim 22, wherein the at least one processing station closing station comprises a further turning station, which is arranged further upstream in the transport direction, for turning the containers.

24. The apparatus in accordance with claim 1, wherein the apparatus comprises a further closing station, which is upstream of the transport device in a feed direction, for closing the containers with closing elements which are configured to fed to the transport device via at least one coupling element and/or introduction element.

25. The apparatus in accordance with claim 1, wherein the apparatus comprises a further transport device which is designed correspondingly to the transport device and to which the containers are transferable via transport elements of the apparatus, as well as at least one further processing station for processing the containers.

26. The apparatus in accordance with claim 25, wherein the further transport device is mounted on a separate frame.

27. The apparatus in accordance with claim 25, wherein the at least one further processing station comprises at least one of the following:

a monitoring station for checking a correct seat of a closing element on the respective container;

a closing station for attaching a closing element to the already closed containers;

a crimping station.

28. The apparatus in accordance with claim 1, wherein the apparatus comprises at least one isolator device, which covers at least one frame, with a cover element, for providing at least one of a protective atmosphere and an atmosphere for decontamination purposes between the cover element and the frame.

29. A filling device for filling pharmaceutical containers being vials, syringes and/or carpules, comprising:

a frame which is positionable on a set-down surface and has a surface, a first side and a second side opposite the first side;

at least one processing station for the containers which comprises a filling station for filling the containers with a pharmaceutical substance and a weighing station; and a transport device, which is arranged between the first side and the second side, with circulating holding elements for the containers which move along a transport direction from a coupling side to a decoupling side on a transport segment and counter to the transport direction on a return segment, wherein the filling station is arranged on the transport segment, and the transport segment and the return segment define a transport plane of the transport device and are arranged directly above the surface and within an outer contour of the frame, wherein the transport plane is inclined by an angle of inclination relative to a plane of the surface and/or a horizontal plane, and the transport segment is arranged above the return segment in the direction of gravity, and wherein the transport device has a free space below the holding elements arranged in the transport segment, the holding elements arranged on the return segment being arranged outside the free space, with the weighing station for the containers engaging in the free space.

30. An apparatus for processing pharmaceutical containers being vials, syringes and/or carpules, comprising:

a frame which is positionable on a set-down surface and has a surface, a first side and a second side opposite thereto, at least one processing station for the containers, a transport device, which is arranged between the first side and the second side, with circulating holding elements for the containers which move along a transport direction from a coupling side to a decoupling side on a transport segment and counter to the transport direction on a return segment, wherein the at least one processing station is arranged at the transport segment, and the transport segment and the return segment define a transport plane of the transport device and are arranged above the surface, wherein the transport plane is inclined by an angle of inclination relative to a plane of the surface and/or a horizontal plane, and the transport segment is arranged above the return segment in the direction of gravity, and wherein the apparatus comprises a plurality of format sets with respective format parts, wherein the format parts have holding element carriers and/or holding elements, wherein the format parts of different format sets differ from one another in a container-specific, container-component-specific and/or processing-specific characteristic, wherein a distance between container receptacles of the holding elements of different format sets is identical.

* * * * *